US006832925B2

(12) United States Patent
Draggie et al.

(10) Patent No.: US 6,832,925 B2
(45) Date of Patent: Dec. 21, 2004

(54) AIRCRAFT GROUND POWER CONNECTOR

(75) Inventors: Raymond Q. Draggie, Spokane, WA (US); Scott D. Maxwell, Renton, WA (US); Emery B. Krzeszowski, Sequim, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/226,602

(22) Filed: Aug. 23, 2002

(65) Prior Publication Data

US 2004/0038576 A1 Feb. 26, 2004

(51) Int. Cl.[7] ..... H01R 13/62
(52) U.S. Cl. ..... 439/263
(58) Field of Search ..... 439/197, 607–610, 439/587, 589, 108, 159, 511, 246, 651, 263, 700

(56) References Cited

U.S. PATENT DOCUMENTS 5,997,360 A * 12/1999 Gen-Kuong et al. ..... 439/700
6,250,955 B1 * 6/2001 Archuleta ..... 439/502
6,341,983 B1 * 1/2002 Crawford et al. ..... 439/587
6,390,848 B1 * 5/2002 Murakami et al. ..... 439/587
6,402,538 B2 * 6/2002 Suzuki ..... 439/271
6,612,856 B1 * 9/2003 McCormack ..... 439/188

OTHER PUBLICATIONS

Lazaro, Jr. et.; US patent application Publication No. US 2002/0039846 titled Aircraft Ground Power Connector; published Apr. 4, 2002.

* cited by examiner

*Primary Examiner*—Jean F. Duverne
(74) *Attorney, Agent, or Firm*—Harness Dickey & Pierce P.L.C.

(57) ABSTRACT

An electromechanical connector for use between an aircraft power connector and a ground power connector. The connector includes a housing and at least one pin and socket assembly disposed at least partially within the housing. The pin and socket assembly includes a pin portion and a socket portion. The pin portion is engageable with a socket of the ground power connector, whereas the socket portion is engageable with an aircraft pin of the aircraft power connector. A socket fitting is disposed within the socket portion to electrically contact the aircraft pin when the aircraft pin is engaged with the socket portion. The pin and socket assembly also includes a collet for gripping the aircraft pin when the aircraft pin is engaged with the socket portion. Further, the connector is configured to allow for individualized adjustment of the frictional force applied by the collet to the aircraft pin.

29 Claims, 4 Drawing Sheets

AIRCRAFT GROUND POWER CONNECTOR

FIELD OF THE INVENTION

The present invention relates generally to ground support power for aircraft and more particularly to a connector for use between ground power carts and aircraft power supply systems.

BACKGROUND OF THE INVENTION

When a commercial airliner is on the ground at a terminal between flights, a ground power cart is wheeled out to the aircraft and used to supply electrical power that would normally be supplied by the aircraft's engine driven generator. The coupling between the ground power cart connector and the aircraft power connector is typically maintained through the physical engagement between the electrical contact pins of the aircraft power connector and the sockets of the ground power connector.

Although the couplings currently being used are successful for their intended purpose (i.e., to allow for transfer of electrical power from the ground power cart to the aircraft power supply), it would be beneficial to provide a connector that even better eliminates and/or absorbs arcing and excessive heating that can occur between the ground power connector and the aircraft power connector when excessive resistance exists therebetween.

Arcing, excessive heating, and the repeated coupling and uncoupling of the ground power connector with the aircraft power connector can lead to damage and ultimately to the eventual breakdown of the aircraft power connector, requiring the replacement of the aircraft power connector and an inspection of the surrounding assembly and associated conducting wires. Replacement of the aircraft power connector, however, can be a rather time-consuming process during which time the aircraft is out of service and the airline loses substantial revenue.

SUMMARY OF THE INVENTION

Accordingly, a need remains in the art for a device and method capable of providing both a strong, secure mechanical connection and a low resistance electrical connection between an aircraft power connector and a ground power connector. Ideally, the device and method should prevent, or at least reduce the extent of, damage to the aircraft power connector that can otherwise be caused thereto by excessive heating, arcing, and the repeated coupling and uncoupling of the aircraft power connector and the ground power connector. Additionally, the implementation of the device and method should not require any changes to either the aircraft assembly or the ground power cart.

In one form, the present invention provides an electromechanical connector for use between an aircraft power connector and a ground power connector. Preferably, the connector includes a housing and at least one pin and socket assembly disposed at least partially within the housing. The pin and socket assembly includes a pin portion and a socket portion. The pin portion is engageable with a socket of the ground power connector, whereas the socket portion is engageable with an aircraft pin of the aircraft power connector. A socket fitting is preferably disposed within the socket portion to electrically contact the aircraft pin when the aircraft pin is engaged with the socket portion. The pin and socket assembly also includes a collet for gripping the aircraft pin when the aircraft pin is engaged with the socket portion. Further, the connector is preferably configured to allow for individualized adjustment of the frictional force applied by the collet to the aircraft pin. Accordingly, the connector provides both a strong, secure mechanical connection and a low resistance electrical connection between the aircraft power connector and the ground power connector.

In another form, the present invention provides a method for connecting an aircraft power connector with a ground power connector. Preferably, the method comprises the steps of: electrically connecting an aircraft pin of the aircraft power connector with a connector; frictionally engaging the aircraft pin; individually adjusting the frictional force applied to the aircraft pin to removably secure the aircraft pin to the connector; and electrically connecting a socket of the ground power connector with the connector.

Further areas of applicability of the present invention will become apparent from the detailed description provided hereinafter. It should be understood that the detailed description and specific examples, while indicating at least one preferred embodiment of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

DETAILED DESCRIPTION OF THE PREFERRED EMBODIMENTS

Figure 1A:
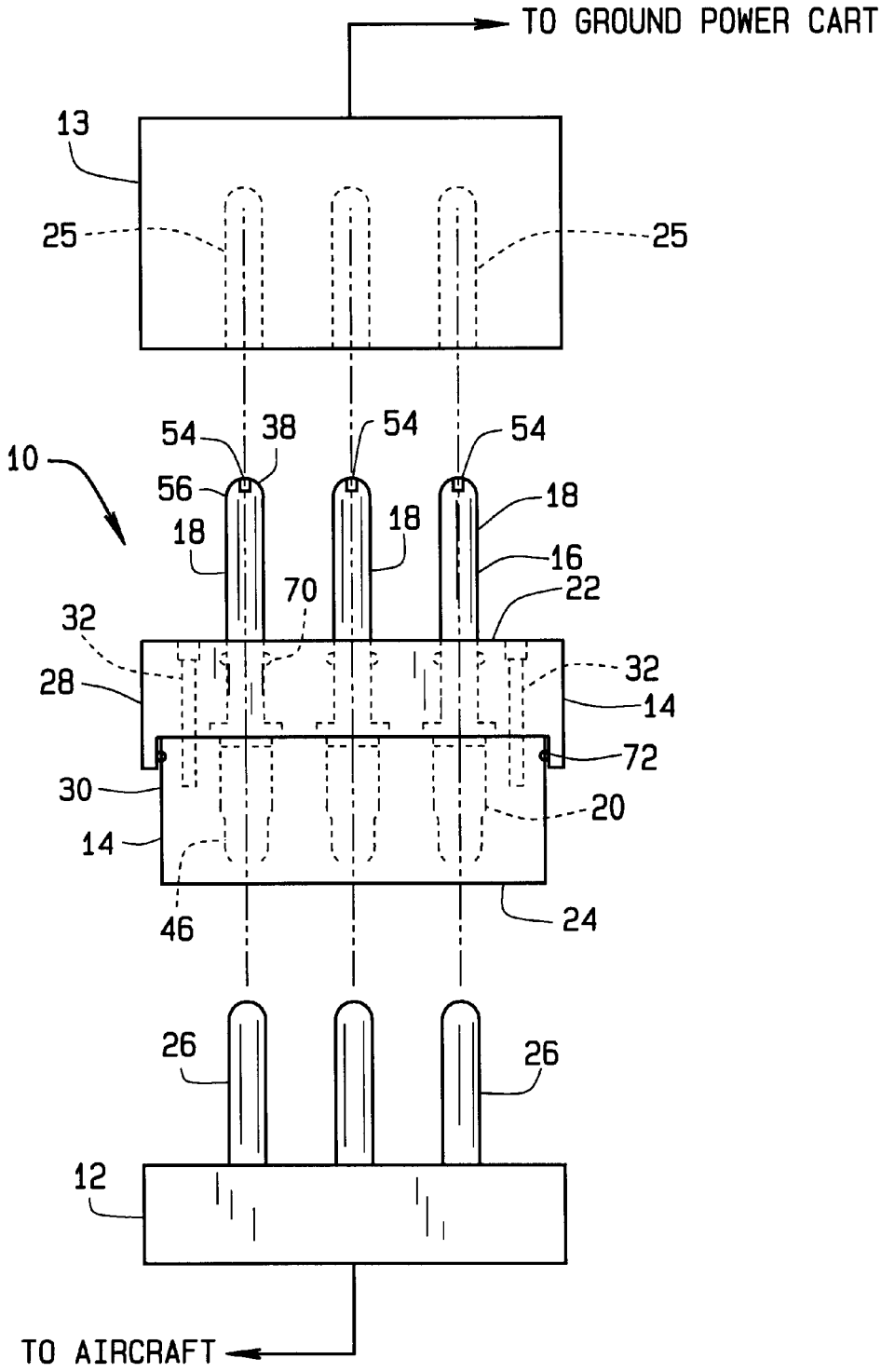
FIG. 1*a* is a plan view of an aircraft power connector and a ground power connector shown aligned for engagement with a connector constructed in accordance with one embodiment of the present invention.
Figure 1B:
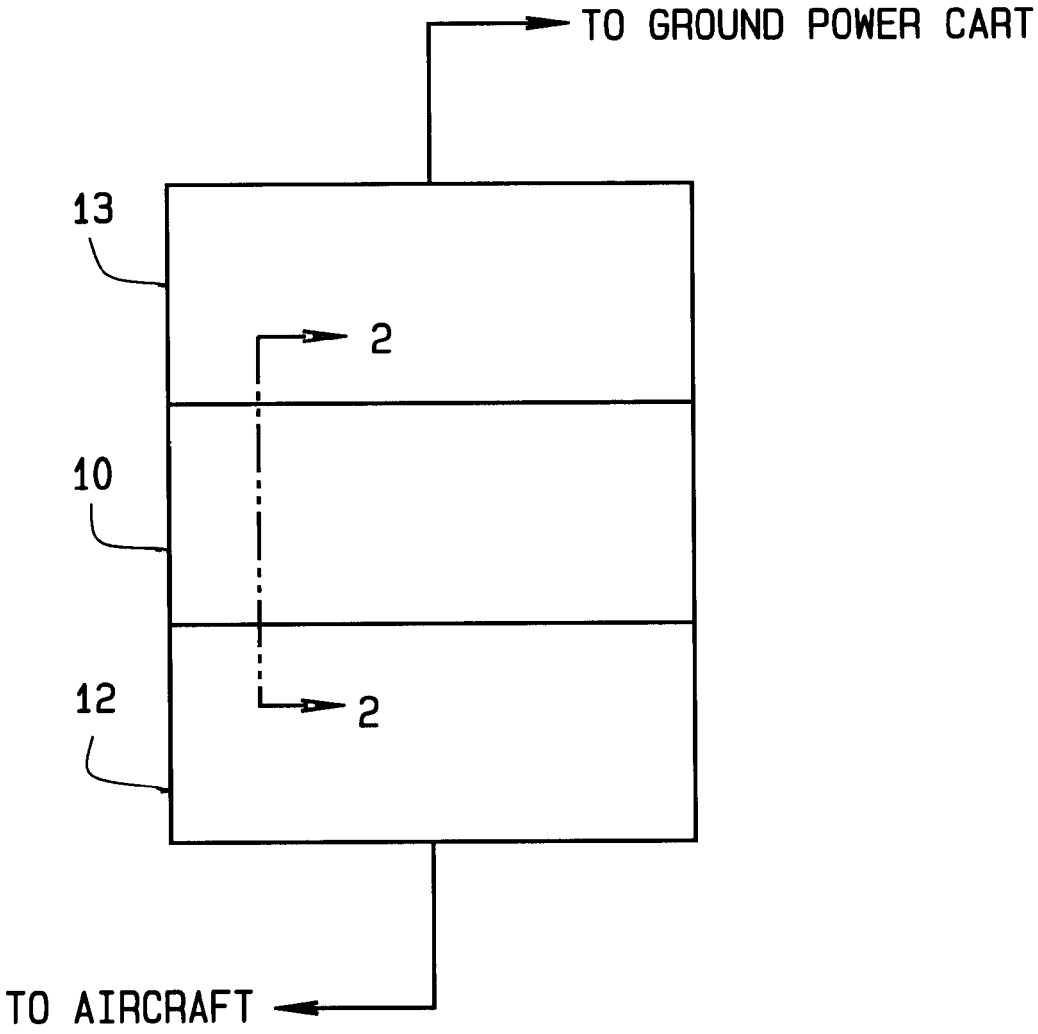
FIG. 1*b* is a high level view of the aircraft power connector and the ground power connector shown engaged with the connector of FIG. 1*a;*

FIGS. 1*a* and 1*b* are plan and high level views, respectively, of a connector, generally indicated by reference number 10, according to one preferred embodiment of the present invention. A well known aircraft power connector 12 and a ground power connector 13 are also shown ready to be coupled to the connector 10 in FIG. 1*a* and shown coupled to the connector 10 in FIG. 1*b*.

Generally, the connector 10 includes a connector body or housing 14 and at least one pin and socket assembly 16 disposed at least partially within the housing 14. The pin and socket assembly 16 includes both a pin or male portion 18 and a socket or female portion 20. The pin portion 18 preferably protrudes from a male side or face 22 of the connector 10, whereas the socket portion 20 is preferably recessed within a female side or face 24 of the connector 10. In addition, it is also preferable to have the pin portion 18 configured for engagement with a socket 25 of the ground power connector 13 and to have the socket portion 20 configured for engagement with a pin 26 of the aircraft power connector 12. Accordingly, the connector 10 may be used to electrically connect the aircraft power connector 12 with the ground power connector 13 so that electrical power may be transferred from a ground power cart to an aircraft power supply while the aircraft is on the ground at a terminal.

It should be noted that the number, arrangement, and size of the pin and socket assemblies 16 may be of any suitable configuration. For aircraft ground power supply applications, however, the standard aircraft power connector configuration is a six-pin arrangement of four power contact pins and two relay contact pins. Accordingly, the connector 10 preferably comprises six (6) pin and socket assemblies 16 that are configured for allowing the connector 10 to be connected directly to standard aircraft ground power supply equipment, such as the widely used MS90362 aircraft power connector.

The housing 14 of the connector 10 will now be discussed in more detail. The housing 14 comprises a multi-piece dielectric housing. The housing 14 includes a first housing portion or pin retainer block 28 and a second housing portion or socket retainer block 30. Alternatively, the housing 114 may comprise a single-piece or unitary block as is shown in the alternative embodiment 110 in FIG. 3. In either connector embodiment 10 or 110, however, the housing 14 or 114 preferably comprises a suitable dielectric material. By way of example only, the housing 14 or 114 may comprise a high-impact thermoplastic material. Alternatively, however, any of a wide range of other suitable dielectric materials may also be used for the housing 14 or 114, and the same material need not be used for both housing portions 28 and 30.

Referring back to FIG. 1*a*, the first and second housing portions 28 and 30 are preferably held together at least partially by one or more screws 32. By way of example only, four screws 32 may be used to engage the first and second housing portions 28 and 30 with each other. The screws 32 may be sized to penetrate through the first housing portion 28 and be threadedly engageable with metal bushings disposed within the second housing portion 30. In addition, the screws 32 may be made from a non-magnetic stainless steel material, although other materials are also possible. Moreover, any one of a wide range of other suitable methods and fasteners may be used instead of screws 32 to maintain the assembled integrity of the connector 10.

Dimensionally, the first housing portion 28 may include a thickness of about 0.8005 inches (2.033 centimeters), and the second housing portion 30 may include a thickness of about 1.50 inches (3.81 centimeters). Alternatively, however, other dimensions may be used for the housing 14 without departing from the spirit and scope of the present invention. Indeed, the various dimensions for the housing portions 28 and 30 and the other various components comprising the connector 10 will likely depend at least in part on the particular application in which the connector 10 is being used.

Figure 2:
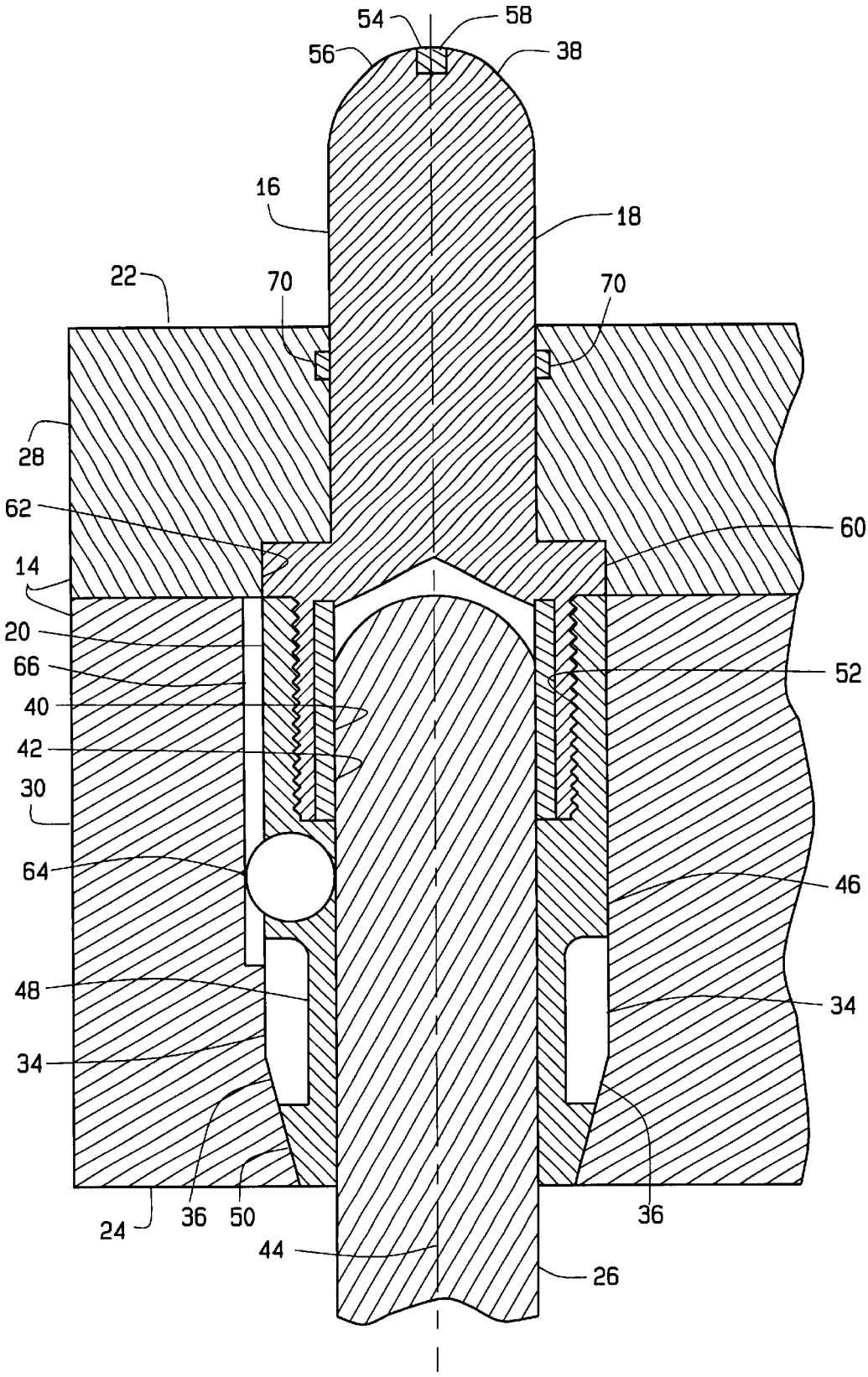
FIG. 2 is a cross-sectional view of one pin of an aircraft power connector engaged with a pin and socket assembly of the connector taken along the plane 2—2 shown in FIG. 1*b*.

FIG. 2 is a cross-sectional view of one of the pin and socket assemblies 16 coupled with a corresponding aircraft pin 26. Although FIG. 2 shows only a single pin and socket assembly 16, the connector 10 preferably comprises six (6) pin and socket assemblies 16. However, each pin and socket assembly 16 may be substantially the same, and each of the preferred six pin and socket assemblies 16 will therefore not be described in detail herein.

The second housing portion 30 is preferably provided with a plurality of holes 34 that correspond to the pin arrangement of the aircraft power connector 12 (e.g., the MS90362 aircraft power connector). As shown in FIG. 2, the hole 34 is sized to receive at least a portion of the pin and socket assembly 16 therein. The hole 34 includes a tapered or conical section 36 that decreases in diameter in the direction towards the female face 24 of the connector 10.

The male or pin portion 18 of the pin and socket assembly 16 is preferably cylindrically configured and has a spherical nose or end 38. In addition, the pin portion 18 is preferably sized to be received within and make electrical contact with a socket 25 of the ground power connector 13. In one preferred embodiment, the connector 10 comprises six pins that are disposed at least partially within the first housing portion 28 such that about 1.50 inches (3.81 centimeters) of the pin portion 18 is exposed and protrudes outwardly from the male face 22 of the first housing portion 28. Alternatively, more or less than 1.50 inches (3.81 centimeters) of the pin portion 18 may extend beyond the male face 22 without departing from the spirit and scope of the present invention.

Any of a wide range of electrically conductive materials may be used for the pin portion 18. By way of example only, the pin portion 18 may comprise silver plated brass.

The female or socket portion 20 of the pin and socket assembly 16 is preferably cylindrical and tubular. In addition, the socket portion 20 is sized to receive a corresponding pin 26 of the aircraft power connector 12 therein.

The connector 10 may further include an electrically conductive socket fitting or insert 40. The socket fitting 40 is preferably disposed within the socket portion 20 so that the aircraft pin 26 electrically contacts the socket fitting 40 when the aircraft pin 26 is fully engaged or inserted into the socket portion 20. Accordingly, the socket fitting 40 defines a portion of a first electrical current path between the aircraft pin 26 and the pin and socket assembly 16.

To provide and ensure a positive conductive connection between the aircraft pin 26 and the pin and socket assembly 16, the socket fitting 40 preferably comprises an electrically conductive, compressible sleeve 42. Initially, the center portion of the compressible sleeve 42 may be bowed or curved inwardly towards the radial and longitudinal center 44 of the pin and socket assembly 16. Upon the full insertion of the aircraft pin 26 into the socket portion 20, however, the compressible sleeve 42 will substantially flatten out thus allowing the aircraft pin 26 to further ensure excellent contact with the compressible sleeve 42. That is, the aircraft pin 26 is able to make contact with the sleeve 42 across substantially the entire inner periphery or surface of the sleeve 42. In short, the sleeve 42 conforms to the aircraft pin 26 when the pin 26 is inserted into the socket portion 20 and also provides a low resistance electrical connection between the aircraft pin 26 and the pin and socket assembly 16.

Any one of wide range of electrically conductive materials may be used for the compressible sleeve 42. By way of example only, the compressible sleeve 42 comprises silver plated copper beryllium.

The pin and socket assembly 16 is preferably configured to apply a frictional force to the aircraft pin 26 when the aircraft pin 26 is inserted into the socket portion 20. As shown in FIG. 2, the pin and socket assembly 16 includes a cylindrical portion or collet 46 that includes a plurality of longitudinal circumferential slots forming a plurality of cantilever beams or fingers 48. The beams 48 are preferably collapsed or curved evenly towards the radial and longitudinal center 44 such that the beams 48, in effect, become individual springs offering a gripping force about the aircraft pin 26 when the pin 26 is disposed within the collet 46.

Accordingly, the beams 48 may be sprung open by the entry of the aircraft pin 26 and may retract back into their collapsed position upon withdrawal of the aircraft pin 26.

The end of each beam 48 may be provided with a raised or wedge portion 50 such that the end of the collet 46 (i.e., the end closest to the female face 24) is configured to interface and nest within the tapered hole portion 36. Accordingly, the housing sides defining the tapered hole portion 36 apply pressure to the outer periphery of the wedge portions 50 with the pressure being sufficient to reduce the size of the collet's 46 inner periphery as the collet 46 either enters or penetrates farther into the tapered hole portion 36. The engagement of the collet 46 with the tapered hole portion 36 compresses or inwardly collapses the collet fingers 48 towards the radial center 44, and thus increases the gripping force applied by the collet 46 to the aircraft pin 26.

Although the collet 46 is shown in FIG. 2 as a separate component that is threadedly engaged to a threaded portion 52 of the pin and socket assembly 16, such need not be the case. In the alternative connector embodiment 110 shown in FIG. 3, the collet 146 and the pin and socket portions 118 and 120 comprise a single part.

Referring back to FIG. 2, the collet 46 preferably comprises an electrically conductive material such that the collet 46 forms a portion of a second or additional electrical current path between the aircraft pin 26 and the pin and socket assembly 16. The collet 46 may comprise silver plated brass. Alternatively, however, any of a wide range of other materials may be used for the collet 46 including both electrically conductive materials and dielectric materials.

Figure 3:
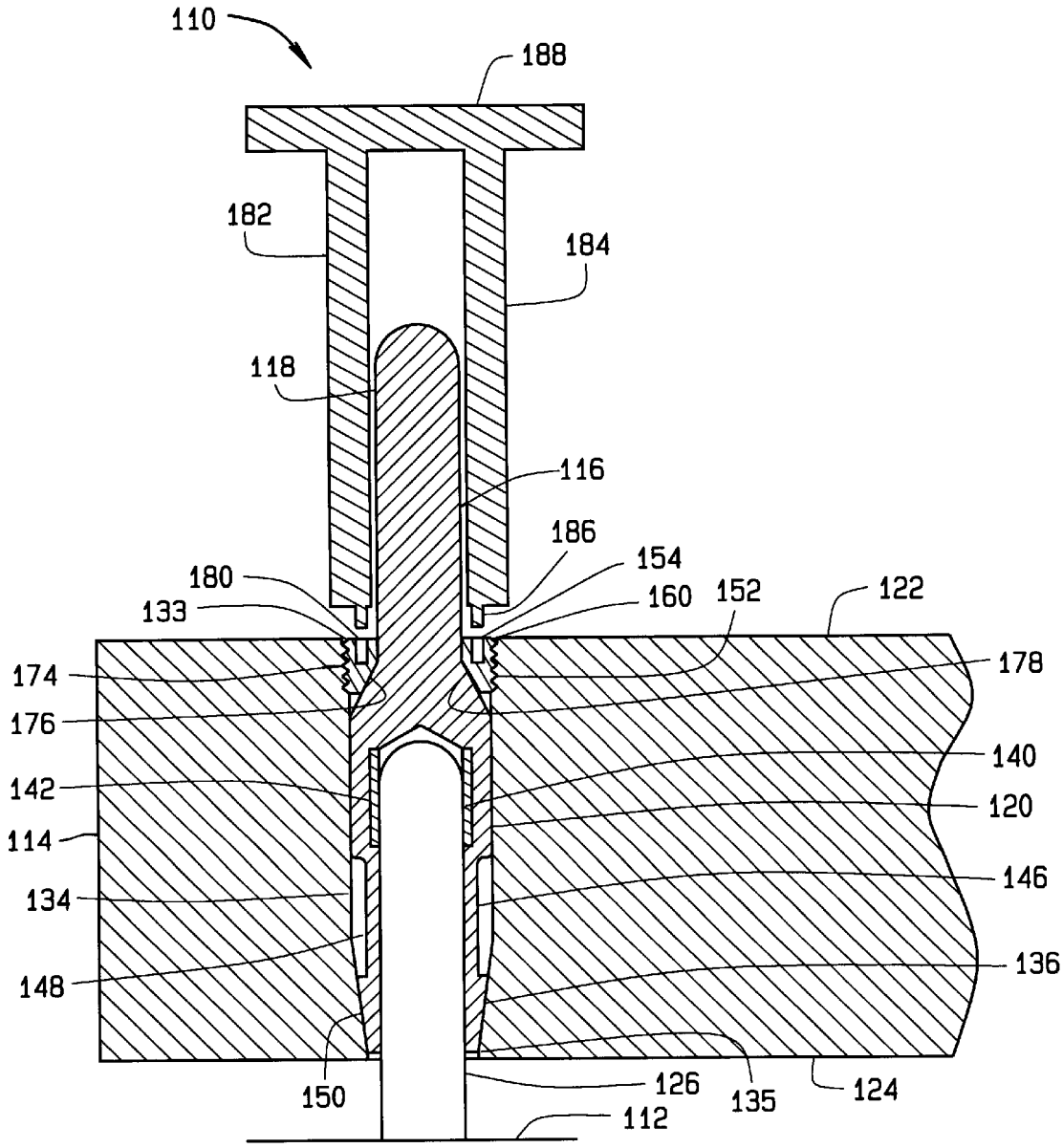
FIG. 3 is a cross-sectional view of one pin of an aircraft power connector engaged with a pin and socket assembly of a connector constructed in accordance with a second embodiment of the present invention.

The connector 10 is preferably configured to allow for individualized adjustment of the frictional or gripping force applied to the aircraft pins 26. That is, the connector 10 may be configured to allow each pin and socket assembly 16 to be individually secured to and unsecured from the corresponding aircraft pin 26. To accommodate for this feature, each pin and socket assembly 16 may be associated with a tool reception site 54 configured for engagement with a tool. By engaging the tool with the tool reception site 54, an operator may use the tool to rotate at least one component of the corresponding pin and socket assembly 16, which in turn will either increase or decrease the frictional force applied by the pin and socket assembly 16 to the aircraft pin 26 depending on the rotational direction (i.e., counterclockwise, clockwise) of the at least one component. In a preferred embodiment, the proximal end or tip 56 of the pin portion 18 defines a slot 58 sized to receive a regular screwdriver blade therein to allow for rotation of the pin portion 18. Alternatively, any one of wide range of other tools and tool reception sites may allow for rotation of at least one component of the connector 10. For example, the tool reception site may be configured for engagement with a Phillips screwdriver or an Allen wrench. Or for example, the tool reception site may comprise a hex head bolt that is configured for engagement with a socket wrench. As yet another example, the tool reception site 154 may be configured for engagement with a spanner wrench 182, as is shown in FIG. 3.

The connector 10 may further include a ball 64 engaged with the collet 46. The ball 64 is sized to be disposed within a keyway 66 formed (e.g., molded, machined, cut, etc.) in the second housing portion 30 adjacent the hole 34. When the ball 64 is disposed within the keyway 66, the ball 64 prevents the collet 46 from rotating within the second housing portion 30.

Dimensionally, the ball 64 is preferably sized such that its diameter is about 0.1875 inches (0.47625 centimeters). The ball 64 may be made from any one of a wide range of materials. By way of example only, the ball 64 may be made from Delrin®, a synthetic resinous plastic material from E.I. Du Pont® De Nemours and Company Corporation of Wilmington, Del.

In other embodiments, a detent or radial protrusion may be provided (e.g., machined) on the collet 46 and may take the place of the ball 64. In these embodiments, the detent or radial protrusion may also be received within the keyway 66 to prevent the collet 46 from being rotated within the second housing portion 30.

The pin and socket assembly 164 may also include a compression collar 60 that is sized to mate or engage a mating surface 62 cut-out of or formed in the first housing portion 28. In the first connector embodiment 10, the compression collar 60 is preferably integral with the pin portion 18. The compression collar 60 and the pin portion 18 may be made from a suitable electrically conductive material (e.g., silver plated brass) as a single part. Alternatively, however, the compression collar 60 and pin portion 18 need not comprise a single component. Instead, the compression collar 160 may comprise a separate component that is engaged with the pin portion 118 as is shown in FIG. 3 for the second connector embodiment 110

The compression collar 60 may be brought into physical contact with the mating surface 62 upon sufficient rotation of the pin portion 18 in the appropriate direction (i.e., clockwise or counterclockwise, depending on the orientation of the threads of the collet 46 and threaded socket portion 52) via the tool reception site 54 and tool engaged therewith. After the compression collar 60 physically contacts the mating surface 62, continued rotation of the pin portion 18 in the same appropriate direction causes the threaded disengagement (i.e., unscrewing) of the collet 46 from the threaded socket portion 52 because the collet 46 is prevented from rotating along with the pin portion 18 by the ball 64. As the collet 46 is being threadedly disengaged from the threaded socket portion 52, the collet 46 moves in the direction of the female connector face 24. Ultimately, the wedge portions 50 of the collet 46 may be forced or compressed into the tapered hole portion 36. This action increases the frictional or gripping force that is being placed on the aircraft pin 26 by the collet 46.

Preferably, the collets 46 are configured such that the combined clamping or frictional force applied to the aircraft pins 26 thereby exceeds the force required to uncouple or disconnect the ground power connector 13 from the connector 10. In a preferred embodiment, the connector 10 is configured for engagement with aircraft power connector MS90362 and accordingly includes six (6) pin and socket assemblies 16. The total gripping force provided by the six pin and socket assemblies 16 is preferably large enough such that good electrical contact is maintained between the aircraft pins 26 and the socket portions 20 even while the ground power connector 13 is being removed or disengaged from the connector 10.

During the normal course of operation, the connector 10 will not likely be exposed to fluids. Nevertheless, as at least a precautionary measure, one or more fluidic sealing members may be disposed at potential fluid entry points for the connector. By way of example only, an O-ring 70 is preferably disposed within the first housing portion 28 circumferentially around the pin portion 18. In addition, an O-ring 72 is preferably disposed circumferentially around the second housing portion 30 at about the interface between the first and second housing portions 28 and 30. Accordingly, the O-rings 70 and 72 assist with the fluidic sealing of the connector 10 to prevent water, corrosive liquids, and other fluids from penetrating the connector 10 and possibly compromising the normal conduction paths contained therein. Preferably, the O-rings 70 and 72 comprise ethylene propylene O-rings, although other types of fluidic sealing members may be used.

The connector 10 may be assembled in the following manner. Although the connector 10 preferably comprises six (6) pin and socket assemblies 16, the steps for assembling each pin and socket assembly 16 may be substantially the same and such steps will not therefore be described in detail for each pin and socket assembly 16.

First, the collet 46 and the ball 64 may be inserted into the hole 34 defined by the second housing portion 30 such that the ball 64 engages the keyway 66. Next, the collet 46 and the threaded socket portion 52 may be threadedly engaged with one another. The compressive sleeve 42 is preferably disposed within the socket portion 52 prior to the threaded engagement of the collet 46 and the threaded socket portion 52. The foregoing process may then be repeated for each of the remaining pin and socket assemblies 16.

After each pin and socket assembly 16 has been disposed within the second housing portion 30, the first housing portion 28 may be placed or slid over the pin portions 18. The mechanical fasteners 32 may then be used to secure the first and second housing portions 28 and 30 to each other.

Once the connector 10 is assembled, the connector 10 may be connected or engaged with the aircraft power connector 12 in the following manner. First, the female side 24 of the connector 10 is pushed over the pins 26 of the aircraft power connector 12 such that each aircraft pin 26 enters a corresponding collet 46. When the aircraft pins 26 are fully inserted into the socket portions 20, each aircraft pin 26 will be in electrical contact with its corresponding compressive sleeve 42.

For each pin and socket assembly 16 then, the appropriate tool may be engaged with the corresponding tool receiving site 54 and used to rotate the corresponding pin portion 18 in the appropriate direction until the corresponding pin and socket assembly 16 is secured to the corresponding aircraft pin 26. Finally, the pin portions 18 of the connector 10 may be engaged with the sockets 25 of the ground power connector 13 to complete the electrical connection between the aircraft power connector 12 and the ground power connector 13.

FIG. 3 is a cross-sectional view of one of the pin and socket assemblies 116 of the second connector embodiment 110 coupled with a corresponding aircraft pin 126. Generally, the connector 110 includes a single-piece connector body or housing 114 and at least one pin and socket assembly 116 disposed at least partially within the housing 114. The pin and socket assembly 116 includes both a pin or male portion 118 and a socket or female portion 120. The pin portion 118 preferably protrudes from a male side or face 122 of the connector 110, whereas the socket portion 120 is preferably recessed in a female side or face 124 of the connector 110. In addition, it is also preferable to have the pin portion 118 configured for engagement with a socket of a ground power connector and to have the socket portion 120 configured for engagement with a pin 126 of an aircraft power connector 112. Accordingly, the connector 110 may be used to electrically connect the aircraft power connector 112 with the ground power connector and thus allow electrical power to be transferred between the ground power cart and the aircraft.

It should be noted that the number, arrangement, and size of the pin and socket assemblies 116 in the second connector embodiment 110 may be of any suitable configuration. Preferably, the connector 110 comprises six (6) pin and socket assemblies 16 that are configured for allowing the connector 110 to be connected directly to standard aircraft ground power supply equipment, such as the widely used MS90362 aircraft power connector.

The housing 114 is provided with a plurality of holes 134 that correspond to pin arrangement of the aircraft power connector 112. Each hole 134 has a proximal end 133 and a distal end 135. The distal end 135 (i.e., the end closest to the female face 124 of the connector 110) is preferably tapered 136 and accordingly assists with retaining the pin and socket assembly 116 within the hole 134. The tapered hole portion 136 also serves to compress the pin collet 146 in a manner described in detail below. The other or proximal end 133 of the hole 134 (i.e., the end closest to the male face 122 of the connector 110) is sized to receive therein a compression collar or ring 160. In addition, the hole 134 also comprises at least a portion 152 that is threaded.

The connector 110 may also include a slotted cylinder portion or collet 146 for applying a frictional or gripping force to the aircraft pin 126 when the pin 126 is disposed within the collet 146. Preferably, the collet 146 is preferably integral with the pin and socket portions 118 and 120 such that the collet 146 and pin and socket portions 118 and 120 comprise a single part or component, although such is not required. The collet 146 and the pin and socket portions 118 and 120 may be machined or formed from silver plated brass as a single part or component. Alternatively, any of a wide range of other electrically conductive materials may be used for the collet 146 and the pin and socket portions 118 and 120.

As before with the first connector embodiment 10, it is generally preferred that a socket fitting or insert 140 be disposed within the socket portion 120 to make electrical contact with the aircraft pin 126. The socket fitting 140 preferably comprises an electrically conductive, compressible sleeve 142 that is conformable to the aircraft pin 126 and that provides a low resistance electrical connection between the aircraft pin 126 and the pin and socket assembly 116. Any one of wide range of electrically conductive materials may be used for the compressible sleeve 142. For example, the compressible sleeve 142 may comprise silver plated copper beryllium.

The connector 110 may also include the compression collar or ring 160 that is sized to be disposed within the end 133 of the hole 134. In addition, the compression collar 160 may define a hole that allows the compression collar 160 to be received over the pin portion 118. The compression collar 160 preferably comprises a threaded outer periphery 174 such that the compression collar 160 is threadedly engageable with the threaded portion 152 of the hole 134. The compression collar 160 also preferably includes a tapered inner surface 176 that is sized to mate or engage with a tapered surface 178 of the pin and socket assembly 116. As shown in FIG. 3, the pin and socket assembly 116 is retained within the hole 134 by the tapered hole portion 136 and the compression collar 160 when the threaded compression collar 160 is threadedly engaged with the threaded hole portion 152.

Preferably, the compression collar 160 comprises a high-impact thermoplastic material. Alternatively, any of wide range of other dielectric materials may be used for the compression collar 160.

The connector 110 is preferably configured to allow for individualized adjustment of the frictional or gripping force applied to the aircraft pins 126. That is, the connector 110 may be configured to allow each pin and socket assembly 116 to be individually secured to and unsecured from the corresponding aircraft pin 126. To accommodate for this feature, each pin and socket assembly 116 may be associated with a tool reception site 154 configured for engagement with a tool. By engaging the tool with the tool reception site 154, an operator may use the tool to rotate at least one component of the corresponding pin and socket assembly 116, which in turn will either increase or decrease the frictional force applied by the pin and socket assembly 116 to the aircraft pin 126 depending on the rotational direction (i.e., counterclockwise, clockwise) of the at least one component. Preferably, the compression collar 160 defines the tool reception site 154. The compression collar 160 may be provided with one or more keyways 180 that are configured for engagement with a spanner wrench 182.

As shown, the spanner wrench 182 comprises a cylindrical tubular portion 184 sized to be received over the pin portion 118. One or more prongs or tines 186 sized to be received within the keyways 180 are disposed at an end of the tubular portion 184. A handle 188 is preferably disposed across the top portion of the spanner wrench 182 to allow a user to more easily grip and twist the spanner wrench 182.

By engaging the tines 186 of the spanner wrench 182 with the keyways 180 in the compression collar 160, an operator may use the spanner wrench 182 to rotate the compression collar 160. Upon sufficient rotation of the compression collar 160 in the appropriate direction (i.e., clockwise or counterclockwise depending on the orientation of the threads of the compression collar 160 and the threaded hole portion 152), the tapered surface 176 of the compression collar 160 will physically contact the tapered surface 178 of the pin and socket assembly 116. After physical contact has been made between the tapered surfaces 176 and 178, continued rotation of the compression collar 160 in the same appropriate direction causes the collet 146 to move in the direction of the female connector face 24. Ultimately, the rotation of the compression collar 160 forces or compresses the wedge portions 150 of the collet 146 into the tapered hole portion 136, which in turn increases the frictional or gripping force that is being placed on the aircraft pin 126 by the collet 146.

Preferably, the collets 146 are configured such that the combined clamping or frictional force applied to the aircraft pins 126 thereby exceeds the force required to uncouple or disconnect the ground power connector from the connector 110. In a preferred embodiment, the connector 110 is configured for engagement with aircraft power connector MS90362 and accordingly includes six (6) pin and socket assemblies 116. And, the total gripping force provided by the six pin and socket assemblies 116 is preferably large enough such that good electrical contact is maintained between the aircraft pins 126 and the socket portions 120 even while the ground power connector is being removed or disengaged from the connector 110.

Regarding possible fluid seepage into the connector 110, the tight union between the compression collar 160 and the pin and socket assembly 116 and between the compression collar 160 and the housing 114 prevents fluid from entering the connector 110 at those junctions. In addition, the housing 114 preferably comprises a single-piece housing and accordingly does not have potential fluid entry points at the junction between two or more housing pieces.

The connector 110 may be assembled in the following manner. Although the connector 110 preferably comprises six (6) pin and socket assemblies 116, the steps for assembling each pin and socket assembly 116 may be substantially the same, and such steps will therefore not be described in detail for each pin and socket assembly 116.

First, the pin and socket assembly 116, with the compressive sleeve 142 disposed within the socket portion 120, may be inserted into the end 133 of the hole 134. The compressive collar 160 may then be slid over the pin portion 118. Next, the tines 186 of the spanner wrench 182 may be engaged with the keyways 180 in the compression collar 160 so that the spanner wrench 182 may be used to threadedly engage the compression collar 160 with the threaded portion 152 of the hole 134. After threadedly engaging the compression collar 160 with the threaded portion 152, the pin and socket assembly 116 is thus retained within the housing 114 between the compression collar 160 and the tapered hole portion 136. The foregoing process may then be repeated for each remaining pin and socket assembly 116 of connector 110.

Once the connector 110 is assembled, the connector 110 may be connected to the aircraft power connector 112 in the following manner. First, the female side 124 of the connector 110 is pushed over the pins 126 of the aircraft power connector 112 such that each aircraft pin 126 enters a corresponding collet 146. When the aircraft pins 126 are fully inserted into the socket portions 120, each aircraft pin 126 will be in electrical contact with the corresponding compressive sleeve 142.

For each pin and socket assembly 116 then, the spanner wrench 182 may be used to rotate the corresponding compression collar 160 in the appropriate direction until the corresponding pin and socket assembly 116 is secured to the corresponding aircraft pin 126. Finally, the pin portions 118 of the connector 110 may be engaged with the sockets of the ground power connector to complete the electrical connection between the aircraft power connector 112 and the ground power connector.

In another form, the present invention provides a method for connecting an aircraft power connector with a ground power connector. Generally, the method comprises the steps of: electrically connecting an aircraft pin 26, 126 of the aircraft power connector 12, 112 to the connector 10, 110; frictionally engaging the aircraft pin 26, 126; individually adjusting the frictional force applied to the aircraft pin 26, 126 to removably secure the aircraft pin 26, 126 to the connector 10, 110; and electrically connecting a socket 25 of the ground power connector 13 with the connector 10, 110.

Accordingly, the present invention provides connectors 10, 110 for use between aircraft power connectors and ground power connectors that prevent, or at least reduce, the damage that can otherwise occur to the aircraft power connectors due to arcing, excessive heating, and/or the repeated uncoupling and coupling of the aircraft power connectors and the ground power connectors. By doing so, the present invention removes one source of aircraft downtime and thus allows airlines to reduce revenue losses associated with the repair and replacement of aircraft power connectors.

The present invention also provides for both a strong, secure mechanical connection and a low resistance electrical connection to be made between an aircraft power connector and a ground power connector. And, in the rare event that arcing and substantial heating does occur, the connector 10 or 110 will absorb a substantial portion of the arcing and/or heat to further reduce the extent of damage that the arcing and heat would otherwise cause to the aircraft power connector. The connector 10 and 110 are also sufficiently robust and rugged to absorb the shock arising from the repeated coupling and uncoupling of the ground power connector thereto.

Additionally, the connectors 10 and 110 can be quickly and easily removed and replaced without affecting the aircraft power connector, should the need arise. Indeed, the connectors 10 and 110 are modular such that only the damaged parts thereof may be replaced instead of replacing them in their entirety.

Further, the connectors 10, 110 are fluidically sealed such that water, corrosive liquids, among other fluids cannot penetrate and compromise the normal conduction paths of the connectors 10 and 110. In addition, the design of the connectors 10 and 110 are not overly complex and accordingly will not cause any undue manufacturing problems.

Implementation of the present invention also does not require any changes to the either the aircraft assembly or the ground power cart. The present invention also allows an operator to readily verify that each pin and socket assembly 16, 116 is secured to its corresponding aircraft pin 26, 126.

In addition, the present invention provides for individual pin compression rather than simultaneous compression. The present invention also spreads the loads substantially uniformly throughout the housings 14 and 114 such that likelihood of either housing 14 or 114 cracking, bowing and leaking due to such cracking and bowing is eliminated, or at least reduced.

It is anticipated that the invention will be applicable to any of a wide range of aircraft (e.g., but not limited to, fighter jets, commercial jets, private jets, propeller powered aircrafts, among others) regardless of the manner in which the aircraft is piloted (e.g., directly, remotely, via automation, or in a combination thereof, among others). Accordingly, the specific references to aircraft herein should not be construed as limiting the scope of the present invention, as the invention could be applied in any implementation where an excellent electromechanical connection is required between two connector components regardless of whether the platform associated with one of the two connector components comprises a mobile platform (e.g., aircraft, ship, etc.) or a fixed or non-mobile platform.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

What is claimed is:

1. A connector for use between a platform power connector and a ground power connector, the connector comprising:

a housing; and at least one pin and socket assembly disposed at least partially within the housing, the pin and socket assembly comprising:

a pin portion engageable with a socket of the ground power connector;

a socket portion engageable with a platform pin of the platform power connector;

a socket fitting disposed within the socket portion, and for electrical contact with the platform pin when the platform pin is engaged with the socket portion; and a collet for frictionally gripping the platform pin when the platform pin is engaged with the socket portion, the connector being configured to allow for individualized adjustment of the frictional force applied by the collet to the platform pin.

2. The connector of claim 1, wherein the connector is configured to allow the pin and socket assembly to be individually secured to and individually unsecured from the platform pin.

3. The connector of claim 1, wherein the housing comprises a first housing portion and a second housing portion.

4. The connector of claim 1, wherein the housing comprises a single-piece housing.

5. The connector of claim 1, wherein the housing defines at least one hole, the hole including a tapered portion sized to apply pressure to an outer periphery of the collet sufficient to reduce the size of an inner periphery of the collet when the collet is engaged with the tapered portion of the hole.

6. The connector of claim 1, wherein the collet is threadedly engaged with a threaded portion of the socket portion.

7. The connector of claim 1, wherein the socket fitting comprises an electrically conductive, compressible sleeve.

8. The connector of claim 1, further comprising a compression collar configured for engagement with at least a portion of the housing.

9. The connector of claim 1, further comprising at least one fluidic sealing member disposed substantially around the pin portion.

10. The connector of claim 1, further comprising at least one fluidic sealing member disposed substantially around the second housing portion.

11. The connector of claim 1, wherein the platform comprises an aircraft.

12. The connector of claim 1, wherein the collet comprises an electrically conductive material which forms at least a portion of an electrical current path between the platform pin and the pin and socket assembly when the platform pin is engaged with the socket portion.

13. The connector of claim 1, wherein an end portion of the collet includes a plurality of fingers to apply a gripping force about the platform pin when the platform pin is disposed within the collet.

14. The connector of claim 13, wherein the housing defines at least one hole including a tapered portion sized to compress the fingers inwardly when the end portion of the collet is moved into the tapered portion at the hole.

15. The connector of claim 1, wherein the at least one pin and socket assembly includes a plurality of pin and socket assemblies, and wherein the connector is configured to enable individualized adjustment of the frictional gripping force applied by each said pin and socket assembly to a corresponding platform pin of the mobile platform.

16. A connector for use between a platform power connector and a ground power connector, the connector comprising:

a housing;

at least one pin and socket assembly disposed at least partially within the housing, the pin and socket assembly comprising:

a pin portion engageable with a socket of the ground power connector;

a socket portion engageable with a platform pin of the platform power connector;

a socket fitting disposed within the socket portion, and for electrical contact with the platform pin when the platform pin is engaged with the socket portion; and a collet for frictionally engaging the platform pin when the platform pin is engaged with the socket portion, the connector being configured to allow for individualized adjustment of the frictional force applied by the collet to the platform pin; and wherein at least one component of the connector includes a tool reception site configured for engagement with a tool to allow for rotation of the at least one component.

17. The connector of claim 16, wherein the at least one component comprises the pin portion.

18. The connector of claim 16, wherein:

the connector further comprises a compression collar configured for threaded engagement with the housing; and the at least one component comprises the compression collar.

19. A connector for use between a platform power connector and a ground power connector, the connector comprising:

a housing;

at least one pin and socket assembly disposed at least partially within the housing, the pin and socket assembly comprising:

pin portion engageable with a socket of the ground power connector;

a socket portion engageable with a platform pin of the platform power connection;

a socket fitting disposed within the socket portion, and for electrical contact with the platform pin when the platform pin is engaged with the socket portion;

a collet for frictionally engaging the platform pin when the platform pin is engaged with the socket portion, the connector being configured to allow for individualized adjustment of the frictional force applied by the collet to the platform pin, wherein the collet comprises:

a plurality of beams; and a plurality of wedge portions, each wedge portion being disposed at an end of a corresponding beam.

20. A connector for use between a platform power connector and a ground power connector, the connector comprising:

a housing;

at least one pin and socket assembly disposed at least partially within the housing, the pin and socket assembly comprising:

a pin portion engageable with a socket of the ground power connector;

a socket portion engageable with a platform pin of the platform power connector;

a socket fitting disposed within the socket portion, and for electrical contact with the platform pin when the platform pin is engaged with the socket portion;

a collet for frictionally engaging the platform pin when the platform pin is engaged with the socket portion, the connector being configured to allow for individualized adjustment of the frictional force applied by the collet to the platform pin; and a ball engaged with the collet, the ball being sized to be disposed within a keyway defined by the housing.

21. A connector for use between an aircraft power connector and a ground power connector, the connector comprising;

a housing; and at least one pin and socket assembly disposed at least partially within the housing, the pin and socket assembly comprising:

a pin portion engageable with a socket of the ground power connector;

a socket portion engageable with an aircraft pin of the aircraft power connector; and a collet for frictionally gripping the aircraft pin when the aircraft pin is engaged with the socket portion, the connector being configured to allow for individualized adjustment of the frictional force applied by the collet to the aircraft pin.

22. A connector for use between a platform power connector and a ground power connector, comprising:

means for electrically connecting the connector with a platform pin of the platform power connector;

means for frictionally gripping the platform pin;

means for individually adjusting the frictional gripping force applied to the platform pin; and means for electrically connecting the connector with a socket of the ground power connector.

23. The connector of claim 22, further comprising means for providing a low resistance electrical connection with the platform pin.

24. A method for connecting a platform power connector with a ground power connector, the method comprising the steps of:

electrically connecting a platform pin of the platform power connector with a connector;

frictionally gripping the platform pin;

individually adjusting the frictional gripping force applied to the platform pin to removably secure the platform pin to the connector; and electrically connecting a socket of the ground power connector with the connector.

25. The method of claim 24, further comprising the step of individually adjusting the frictional force applied to the platform pin to allow for disengagement of the platform pin from the connector.

26. The method of claim 24, wherein the step of electrically connecting a platform pin of the platform power connector with a connector comprises receiving the platform pin within a socket portion of the connector.

27. The method of claim 26, wherein the step of electrically connecting a platform pin of the platform power connector with a connector comprises electrically connecting the platform pin with a socket fitting disposed within the socket portion.

28. The method of claim 24, wherein the step of electrically connecting a socket of the ground power connector with the connector comprises receiving a pin portion of the connector within the socket.

29. A method for connecting a platform power connector with a ground power connector, the method comprising the step of:

electrically connecting a platform pin of the platform power connector with a connector;

frictionally engaging the platform pin;

individually adjusting the frictional force applied to the platform pin to removably secure the platform pin to the connector, the individually adjusting comprising:

engaging a tool with a tool reception site defined by at least one component of the connector; and rotating the at least one component with the tool; and electrically connecting a socket of the ground power connector with the connector.

* * * * *